US006575824B2

(12) United States Patent
Kuramochi et al.

(10) Patent No.: US 6,575,824 B2
(45) Date of Patent: Jun. 10, 2003

(54) ABRASIVE MOLDING AND ABRASIVE DISC PROVIDED WITH SAME

(75) Inventors: Hideto Kuramochi, Yokohama (JP); Satoshi Kondoh, Yokohama (JP); Yoshinori Harada, Sagamihara (JP); Mutsumi Asano, Sagamihara (JP)

(73) Assignee: Tosoh Corporation, Yamaguchi (JP)

( * ) Notice: Subject to any disclaimer, the term of this patent is extended or adjusted under 35 U.S.C. 154(b) by 0 days.

(21) Appl. No.: 09/867,535

(22) Filed: May 31, 2001

(65) Prior Publication Data

US 2002/0016146 A1 Feb. 7, 2002

(30) Foreign Application Priority Data

Jun. 1, 2000 (JP) ..... 2000-169056

(51) Int. Cl.[7] ..... B24D 11/00

(52) U.S. Cl. ..... 451/527; 451/526; 451/540; 451/541; 451/548; 51/295; 51/296; 51/307

(58) Field of Search ..... 451/526, 527, 451/540, 541, 548; 51/295, 296, 307

(56) References Cited

U.S. PATENT DOCUMENTS 5,611,829 A * 3/1997 Monroe et al. ..... 51/309
5,908,478 A * 6/1999 Wood ..... 51/309
6,328,644 B1 * 12/2001 Kuramochi et al. ..... 451/526

FOREIGN PATENT DOCUMENTS

| | | |
|---|---|---|
| JP | 4256581 | 9/1992 |
| JP | 10264015 | 10/1995 |
| JP | 10337669 | 12/1998 |

* cited by examiner

*Primary Examiner*—Joseph J. Hail, III
*Assistant Examiner*—Shantese McDonald
(74) *Attorney, Agent, or Firm*—Nixon & Vanderhye P.C.

(57) ABSTRACT

An abrasive molding comprising at least 90% by weight, based on the abrasive molding, of an inorganic material having a stock hardness of 50–400 kg/mm$^2$, and said abrasive molding having a relative density of 20–70% and an average particle diameter of 0.001–50 $\mu$m. The abrasive molding preferably has pores having a pore size distribution such that the integrated pore volume of pores having a diameter of 0.01–1 $\mu$m is at least 20% of the integrated total pore volume of the entire pores, and the integrated pore volume of pores having a diameter of 1–360 $\mu$m is in the range of 10% to 70% of the integrated total pore volume of the entire pores. The abrasive molding is suitable for polishing a material having a Vickers hardness not larger than 300 kg/mm$^2$.

11 Claims, No Drawings

ABRASIVE MOLDING AND ABRASIVE DISC PROVIDED WITH SAME

BACKGROUND OF THE INVENTION (1) Field of the Invention

This invention relates to an abrasive molding and an abrasive disc provided with at least one abrasive molding, which are used in a process for polishing or chemicomechanically polishing substrate materials, for example, for substrates such as a semiconductor substrate, a chemical compound semiconductor substrate, a mild metal substrate, a glass substrate and silica glass substrate, optical materials, and organic materials such as plastic and other resin materials.

(2) Description of the Related Art

With the advance of industries including an optical industry and an electronic industry, a higher precision is required for processing materials for a magnetic disc, a semiconductor substrate, an optical material and other substrate materials. That is, there is an increasing demand for obtaining higher smoothness and flatness by polishing the material surface in the finishing process thereof.

A loose abrasive machining has been widely employed in the conventional polishing process, wherein a substrate material is polished with a polishing pad made of nonwoven fabric or suede while a polishing liquid containing a loose abrasive grain is continuously applied onto the polishing surface. The loose abrasive grain is composed of, for example, aluminum oxide, silicon oxide, cerium oxide, zirconium oxide, iron oxide, titanium oxide, manganese oxide or silicon carbide.

The conventional polishing process using a loose abrasive grain has a problem such that a polishing pad used has a very low modulus and thus the substrate material is not uniformly abraded over the entire surface to be polished, i.e., the corner portions of the material surface are excessively abraded upon polishing.

If a polishing pad is used together with a polishing liquid containing no loose abrasive grain, such as water having an adjusted pH value, the polishing power is too weak to complete the polishing within a reasonably short time. Even if a loose abrasive grain is Incorporated in an amount of about 10% or smaller in a polishing liquid, the polishing performance is still low. Usually 20 to 30% by weight or larger of a loose abrasive grain must be incorporated in a polishing liquid to obtain a polishing rate raised to a satisfying extent and to obtain a polished surface having no scratches or pits. However, the polishing liquid containing a loose abrasive grain must be continuously applied onto the polishing surface and thus the cost for loose abrasive grain is large. Further, a salient amount of a waste polishing liquid containing a loose abrasive grain is produced, and therefore, equipment for the waste disposal and the environmental pollution with the waste polishing liquid must be considered.

To solve the above-mentioned problems, a proposal has been made in Japanese Unexamined Patent Publication (hereinafter abbreviated to "JP-A") No. H4-256581 wherein a synthetic abrasive stone comprising abrasive grain particles combined with a synthetic resin binder is used. It is described in this patent publication that the problem of non-uniform abrading can be mitigated or avoided. However, the use of a synthetic resin as a binder causes another problem such that the abrasive stone tends to be clogged with the synthetic resin, leading to reduction of polishing performance and productivity. Further, depending upon the abrading conditions, the synthetic resin occasionally causes contamination of a polished material with impurities from the synthetic resin.

An abrasive molding predominantly comprised of an abrasive silica grain is described in JP-A H10-264015. The following findings are described in this patent publication.

(1) The abrasive molding has a modulus higher than that of a polishing pad, and thus, excessive abrasion of the corner portions of the material surf ace occurring upon polishing can be minimized, and the substrate material can be uniformly abraded over the entire surface to be polished.

(2) The abrasive molding has a rough surface composed of silica particles, among which a multiplicity of pores are formed, and therefore, a problem such that an abrasive molding tends to be clogged during polishing can be minimized or avoided.

(3) The abrasive molding does not contain a synthetic resin and hence the abrasive molding exhibits high thermal resistance, chemical resistance and water resistance in the polishing process. Therefore, a high polishing efficiency can be obtained by using an appropriate polishing liquid in a temperature range reaching approximately the boiling point.

(4) The abrasive molding is composed of silica particles used as abrasive grain, and the molding does not contain a synthetic resin. Therefore, the abrasive molding does not cause contamination of a polished material.

(5) The smooth polished surface and the rate of polishing achieved with the abrasive molding are of the same level as or higher level than those of the conventional polishing processes using a polishing pad. The smooth finish and the rate of polishing are not decreased with a lapse of polishing time.

(6) The molding abrasive has a rough surface composed of silica particles. The hard and fine abrasive surface of the silica particles are brought into direct contact with a material to be polished, and hence, a polishing liquid which does not contain loose abrasive grains can be used for polishing with the abrasive molding.

(7) Even if an abrasive loose grain is used in combination with the abrasive molding, a high rate of polishing can be achieved with a polishing liquid containing the abrasive loose grain at a low concentration, as compared with the conventional polishing process using a polishing pad.

Although the abrasive molding composed of silica particles used as abrasive grain, described in JP-A H10-264015, is suitable for polishing machining process or chemicomechanical polishing process (hereinafter abbreviated to "CMP process") for substrate materials such as a silicon wafer, oxide substrate, a chemical compound semiconductor substrate, a glass substrate and ceramic substrate, and optical materials, in the case when a mild substrate material is polished, full consideration must be given for selection of material of abrasive grain used and particle size thereof to completely avoid formation of worn marks caused by polishing. Even if a polishing liquid containing no abrasive grains is used, the abrasive molding sometimes causes worn marks on a polished surface and thus the optimal polishing conditions are difficult to determine.

A grinding stone consisting of sintered body of inorganic abrasive grains is described in JP-A H10-337669. It is taught in this patent publication that good results similar to those obtained by the abrasive molding of JP-A H10-264015, can be achieved by suitably selecting the material and particle size of abrasive grains, and the porosity and water absorption of the grinding stone. However, the polished surface of silicon wafer as an example of the material to be polished exhibits a surface roughness of approximately 3 nm as expressed in terms of center line mean surface roughness. The rate of polishing is not referred to in this patent publication.

In the above-stated JP-A H10-264015, the surface roughness of a polished material is expressed in terms of those values as measured by using a universal surface tester SE-3C available from Kosaka kenkyusho K. K. But, we found some difficulty in accurately measuring the surface roughness of a polished surface having a very low roughness by the same surface tester. Thus, we repeated the measurement of surface roughness of the polished surface obtained by the abrasive molding described in JP-A H10-264015, by using an atomic force microscope (AFM; "SPI3600" available from SII Co.), and found that the polished surface has a center line mean surface roughness of 0.6 nm to 1 nm, namely, the surface roughness is better than that of the polished surface obtained by the grinding stone described in JP-A H10-337669.

In view of the foregoing state of the prior art, it has been eagerly desired that to provide an abrasive molding which is capable of polishing a mild material at a high polishing rate to give a smooth polished surface having a high surface precision and no worn marks, and which is characterized, when the abrasive molding is used as an abrasive grain, in that determination of the material suitable for the particular substrate material and the particle size of abrasive grain can be easily made.

SUMMARY OF THE INVENTION

A primary object of the present invention is to provide an abrasive molding, which is suitable for polishing machining process or CMP process for substrate materials such as a semiconductor substrate, an oxide substrate and a glass substrate, and for optical materials for which a high precision machining is required, and further to provide a polishing disc provided with at least one of the abrasive molding.

More specifically, a primary object of the present invention is to provide an abrasive molding and a polishing disc provided with at least one abrasive molding; which abrasive molding is capable of polishing a material to be polished with a high efficiency by using a polishing liquid containing no loose abrasive grains or containing a minor amount of loose abrasive grains, and thus, the polishing cost is reduced and the problem of waste polishing liquid containing loose abrasive grains is mitigated; and is capable of polishing the material with a higher efficiency to give a smooth polished surface of the same level as or higher level than those of the conventional polishing processes using a polishing pad; said polished surface having no worn marks produced by polishing.

Another object of the present invention is to provide a abrasive molding which is especially suitable for polishing a mild material having a Vickers hardness not larger than 300 kg/mm$^2$, and further to provide a polishing disc provided the abrasive molding.

In accordance with the present invention, there is provided an abrasive molding which comprises at least 90% by weight, based on the weight of the abrasive molding, of an inorganic material having a stock hardness of 50 kg/mm$^2$ to 400 kg/mm$^2$, and which has a relative density of 20% to 70% and an average particle diameter of 0.001 $\mu$m to 50 $\mu$m.

DESCRIPTION OF THE PREFERRED EMBODIMENTS

Abrasive Molding

An abrasive molding of the present invention is characterized as comprising at least 90% by weight, based on the weight of the abrasive molding, of an inorganic material having a stock hardness of 50 kg/mm$^2$ to 400 kg/mm , and having a relative density of 20% to 70% and an average particle diameter of 0.001 $\mu$m to 50 $\mu$m.

The inorganic material constituting the abrasive molding has a stock hardness of 50 kg/mm$^2$ to 400 kg/mm$^2$, that is, the abrasive molding has a relatively low hardness, and therefore, the surface precision of a polished surface can be of the same level as or higher than those of the conventional polishing processes using a polishing pad, and worn marks are not formed on the material surface upon polishing.

The abrasive molding is especially suitable for polishing a mild material having a Vickers hardness not larger than 300 kg/mm$^2$. The mild material to be polished is not particularly limited. As specific examples of the mild material, there can be mentioned mild metals such as aluminum, copper and silver, and resins.

By the term "stock hardness" herein used, we mean an average Vickers hardness of sintered bodies of the inorganic material as measured according to JIS (Japanese Industrial Standard)-R-1610 under a load of 10 kg and a load retention time of 10 seconds, which sintered bodies have a relative density of at least 95% and an average particle diameter of 0.1 $\mu$m to 50 $\mu$m and are prepared by a process wherein a powdery inorganic material having an average primary particle diameter of 0.1 $\mu$m to 5 $\mu$m is made into a molding by press-molding or powder-molding and the molding is then sintered.

As specific examples of the powdery inorganic material used for the preparation of the abrasive molding having the desired hardness, there can be mentioned powders of titanium oxide, tin oxide and zinc oxide. Of these, titanium oxide powder is preferable because it exhibits high stability against a polishing liquid used for polishing and it is easy to make, and further, it has a low stock hardness and thus, an abrasive molding made thereof gives a polished surface having no worn mark when a mild material having a Vickers hardness not larger than 300 kg/mm$^2$ is polished. The crystal form of titanium oxide is not particularly limited and includes titanium monoxide, dititanium trioxide, titanium dioxide, and other forms. Amorphous titanium oxide may also be used. However, in view of stability in the air atmosphere, titanium dioxide is most preferable.

If an inorganic material having a stock hardness of larger than 400 kg/mm$^2$ is used, it is possible that worn marks are formed on a material surface when polished and, when a loose abrasive grain is used, full consideration must be given for the determination of kind and particle size of the abrasive grain. In contrast, if an inorganic material having a stock hardness of smaller than 50 kg/mm$^2$ is used, the resulting abrasive molding has poor mechanical strength and it is possible that the abrasive molding is liable to be damaged or cutouts tend to be formed on the abrasive molding.

The amount of the inorganic material having a stock hardness of 50 kg/mm$^2$ to 400 kg/mm$^2$ must be at least 90% by weight, based on the weight of the abrasive molding. If the amount of an inorganic material having the specified stock hardness is smaller than 90% by weight, worn marks are liable to be formed on a material surface when polished and, when a loose abrasive grain is used, full consideration must be given for the determination of kind and particle size of the abrasive grain. The amount of the inorganic material having the specified stock hardness used herein means the amount as expressed by its dry weight based on the dry weight of the abrasive molding.

The ingredients, which are preferably not contained in the abrasive molding, but which are permitted to be contained in an amount of not larger than 10% by weight in the abrasive molding, usually includes metal oxides having a stock hardness falling outside the above-specified range, and loss on ignition. These ingredients in the abrasive molding are derived from the raw materials.

The abrasive molding of the invention has a relative density of 20% to 70%. This relative density range is important for giving the abrasive molding an appropriate shape-retention and achieving polishing with a high efficiency. If the relative density is too small, the shape retention of the abrasive molding is poor and the abrasive molding is abraded to undesirably large extent during polishing. In contrast, if the relative density is too large, the abrasive molding has too high mechanical strength and a material to be polished tends to be damaged during polishing, and the surface of the abrasive molding becomes too smooth leading to reduction of polishing rate. The relative density is determined by the method mentioned below.

The abrasive molding of the invention is composed of particles of an inorganic material having the above-specified stock hardness, which are bonded together. The particles constituting the abrasive molding have an average particle diameter of 0.001 $\mu$m to 50 $\mu$m. When the particle size is in this range, a porous abrasive molding can be easily made and a smooth polished surface of an acceptable precision can be obtained with a high efficiency. In general, powdery inorganic materials having an average particle diameter smaller than 0.001 $\mu$m are not available and thus an abrasive molding composed of particles having an average particle diameter smaller than 0.001 $\mu$m is difficult to make. If the average particle diameter of the particles constituting the abrasive molding is larger than 50 $\mu$m, a material to be polished tends to be damaged during polishing. More preferably, the particles of inorganic particle constituting the abrasive molding are titanium oxide particles having an average particle diameter of 0.001 $\mu$m to 10 $\mu$m. The average particle diameter of the particles constituting the abrasive molding is measured by the method using a scanning electron microscope (SEM), mentioned below.

To enhance the rate of polishing and keep the high polishing efficiency for a long working time, the abrasive molding of the invention preferably has a pore size distribution such that the integrated pore volume of pores having a diameter in the range of 0.01 $\mu$m to 1 $\mu$m is at least 20% of the integrated total pore volume of the entire pores within the abrasive molding. More preferably, the integrated pore volume of pores having a diameter in the range of 1 $\mu$m to 360 $\mu$m is in the range of 10% to 70% of the integrated total pore volume of the entire pores within the abrasive molding. The integrated pore volume is determined by the method described below.

The abrasive molding of the present invention usually has a compressive strength of at least 1 kg/cm$^2$.

If desired, organic materials may be incorporated in pores within the abrasive molding of the invention. In the case where organic materials are incorporated in the pores, the abrasive molding should satisfy the above-mentioned requirements for relative density, average particle diameter and pore size distribution before the organic materials are incorporated in the pores.

An especially preferable abrasive molding of the present invention comprises at least 90% by weight, based on the weight of the abrasive molding, of titanium oxide, most preferably titanium dioxide, and has a relative density of 20% to 70% and an average particle diameter of 0.001 $\mu$m to 10 $\mu$m, and has a pore size distribution such that the integrated pore volume of pores having a diameter in the range of 0.01 $\mu$m to 1 $\mu$m is at least 20% of the integrated total pore volume of the entire pores within the abrasive molding, and the integrated pore volume of pores having a diameter in the range of 1 $\mu$m to 360 $\mu$m is in the range of 10% to 70% of the integrated total pore volume of the entire pores within the abrasive molding.

Process for Producing Abrasive Molding

The process for producing the abrasive molding of the present invention is not particularly limited, and various processes can be employed wherein an inorganic material capable of producing the above-mentioned abrasive molding is molded under pressure and then, if desired, the molded product is sintered or fired or subjected to other treatment.

The molding under pressure of the powdery inorganic material includes, for example, press molding of a powdery inorganic material, carried out under conventional pressure conditions, and cast molding, Injection molding and extrusion molding.

The powdery inorganic material may be subjected to a pretreatment for enhancing the moldability of the material. As examples of the pretreatment procedure, there can be mentioned a compacting procedure wherein the powdery inorganic material is compacted under various conditions, a pelletizing procedure wherein the powdery inorganic material is dissolved or dispersed in an aqueous medium and the thus-obtained aqueous solution or dispersion is pelletized by spray drying or rolling, an organic material-incorporating procedure wherein an organic material such as wax or a binder is incorporated in the powdery inorganic material, and a wetting procedure wherein water is added to the inorganic material.

In the organic material-incorporating procedure, the inorganic material having incorporated therein an organic material such as wax or a binder is preferably subjected to a degreasing treatment after the organic material-incorporated inorganic material is shaped into a molding, but before the final abrasive molding is obtained. For example, the degreasing treatment can be carried out by heating the organic material-incorporated inorganic material in the air atmosphere or in an inert gas atmosphere such as nitrogen, argon or helium under enhanced pressure, normal pressure or reduced pressure. In the wetting procedure, the water-added material is dried after the water-added material is shaped into a molding but before the molding is sintered.

An as-shaped abrasive molding, especially, as-shaped abrasive molding from which a binder has been removed, has a poor mechanical strength. Hence, the as-shaped abrasive molding is preferably sintered or fired to enhance the mechanical strength and durability for polishing. As another procedure for imparting durability to the as-shaped abrasive molding, a reinforcing material can be introduced into pores within the as-shaped abrasive molding.

Sintering or firing of the as-shaped abrasive molding is carried out under various conditions. Appropriate sintering or firing conditions such as temperature, time, program and atmosphere may suitably be determined.

Thus, an abrasive molding having a mechanical strength enough for withstanding the polishing operation can be made by suitably employing a procedure including, for example, heat-degreasing, sintering or firing, machining, chemical treatment or physical treatment, or a combination of these treatments.

Abrasive Disc

An abrasive disc is made by assembling at least one of the above-mentioned abrasive molding with a supporting auxiliary. The supporting auxiliary used includes, for example, metal plate and other shaped parts. The material and shape of the supporting auxiliary are not particularly limited and can be appropriately chosen depending upon the particular abrasive disc. The abrasive molding or moldings are fixed to the supporting auxiliary, for example, by an adhering procedure using an adhesive, or a procedure of fitting the abrasive moldings into recesses formed on the supporting auxiliary.

The number of abrasive molding fixed to a supporting auxiliary is not particularly limited and is preferably at least two. When polishing is conducted by using an abrasive disc having two or more abrasive moldings fixed to a supporting auxiliary in an arrangement such that a polishing liquid applied is discharged through drainage conduits formed between adjacent abrasive moldings, the rate of polishing can be enhanced. Further, the abrasive moldings are brought into uniform contact with the entirety of a material to be polished, and uniform polishing can be effectively achieved. When an abrasive disc having a single abrasive molding fixed to a supporting auxiliary is used, a conduit for draining a polishing liquid is preferably formed on the polishing surface of the abrasive molding.

The shape of the abrasive molding is not particularly limited, and includes, for example, a columnar pellet having a circular cross-section, a square pillar shaped pellet having a triangular or quadrilateral cross-section, and a columnar pellet having a scallop-shaped cross-section, and hollow columnar pellets such as ring-shaped pellet. The size of the abrasive molding is also not particularly limited and can be suitably chosen depending upon the supporting auxiliary used.

The fashion by which abrasive moldings are arranged on a supporting auxiliary for constituting an abrasive disc is not particularly limited. For example, a plurality of small abrasive moldings are combined together to form an integrated moldings which are fitted to a supporting auxiliary, or a plurality of abrasive moldings are embedded in a large circular supporting auxiliary.

When a plurality of abrasive moldings are arranged on a supporting auxiliary, the configuration of polishing surfaces of the arranged abrasive moldings preferably conform to the polishing surface of a material to be polished. In this case, a supporting auxiliary having a surface configuration conforming to a material surface to be polished can be used. For example, when a material surface to be polished is flat, the abrasive moldings are fitted so that heights of polishing surfaces of the abrasive moldings from the surface of the supporting auxiliary are uniform over the entire polishing surfaces, and thus, the polishing surfaces of the abrasive moldings form a flat polishing surface. When a surface to be polished is curved, the polishing surfaces of the arranged abrasive moldings preferably form a similarly curved surface. By such arrangement of abrasive moldings, a material surface to be polished can be brought into direct and uniform contact with the entire polishing surfaces of the abrasive moldings. Thus, maximum and uniform contact between the polishing surfaces of abrasive moldings and the surface of a material to be polished can be obtained.

The shape of abrasive disc can be such that the polishing surfaces of abrasive moldings form a surface conforming to a material surface to be polished, as mentioned above, and can be any shape of flat sheet, circular disc, ring-shape and column, provided that the polishing surfaces are brought into direct contact with the material surface to be polished, and the disc has a enough mechanical strength and can polish the material.

Polishing Process Using Abrasive Disc

The polishing process using the above-mentioned abrasive disc is not particularly limited, and the shape of abrasive disc, polishing conditions and polishing liquid can be appropriately chosen. The use of a polishing liquid is optional and, when a polishing liquid is used, conventional polishing liquids can be employed which include, for example, aqueous solutions of potassium hydroxide, sodium hydroxide, an amine, an organic acid, a water-soluble organic substance and hydrogen peroxide, and organic solvents such as an alcohol. These polishing liquids are used at a temperature lower than the boiling point thereof. The flow rate of polishing liquid, the polishing pressure, the relative speed between the material to be polished and the abrasive disc (namely, the rate of rotation of the abrasive disc) and other polishing conditions are not particularly limited and can be appropriately chosen.

In the polishing process using the above-mentioned abrasive disc, polishing is effected without use of a polishing cloth. The abrasive disc used is more durable, i.e., has a longer operable life, than a polishing cloth. Thus, the frequency of exchange is reduced and the efficiency of polishing is enhanced, as compared with the conventional polishing process using a polishing cloth.

A polishing liquid containing a minor amount of loose abrasive grains, or not containing loose abrasive grains, is used in the polishing process using the abrasive disc of the invention, and hence, the problem of waste disposal can be mitigated or avoided. Light transmission at a wavelength of 600 nm of the waste polishing liquid Is at least 10%. The material and size of the loose abrasive grains are appropriately chosen depending upon the intended use thereof.

The material to be polished or chemicomechanically polished by the abrasive disc of the invention includes, for example, substrate materials such as a semiconductor substrate, an oxide substrate, a mild metal substrate, a glass substrate and silica glass substrate, magnetic head materials, glass materials, metal materials, optical materials such as lens, and building materials such as building stones. The abrasive disc is especially advantageously employed in CMP process for substrates including a semiconductor substrate.

The abrasive molding is especially suitable for polishing a mild material having a Vickers hardness not larger than 300 kg/mm$^2$. The mild material to be polished is not particularly limited. As specific examples of the mild material, there can be mentioned mild metals such as aluminum, copper and silver, and resins.

The invention will now be described specifically by the following examples that by no means limit the scope of the invention.

Characteristics of abrasive moldings and abrasive discs were determined by the following method.

(1) Content of Ingredients in Abrasive Molding (% by weight)

The moisture content in powdery raw material, loss on ignition thereof, and the purities of titanium oxide powder, aluminum oxide powder and cerium oxide powder, used as raw materials, were determined as follows.

The purities of titanium oxide powder, aluminum oxide powder and cerium oxide powder were measured by an ICP atomic emission spectrochemical analysis, and expressed in terms of the contents of the respective metal oxides.

The moisture content in a raw material powder was calculated from the weights as measured before and after the raw material powder was heated at 110° C. for 2 hours to remove moisture.

The loss on ignition of a raw material powder was determined by heating the powder at 110° C. for 2 hours to remove moisture, and further heating the moisture-removed powder at 1,100° C. for 2 hours, and calculating the loss on ignition from the weights as measured before and after the heating at 1,100° C. for 2 hours.

(2) Vickers Hardness of Material to Be Polished

Vickers hardness was determined on a mirror-finished surface of a sample material to be polished according to JIS-R-1610 by a microhardness tester ("MVK-E" available from Akashi Seisakusho K. K., Japan). An indenter was pressed against the sample surface at room temperature under a load of 100 g for a load-retention time of 10 seconds.

(3) Relative Density of Abrasive Molding (%)

A sample of abrasive molding with a flat plate-form having a size of 100 mm×100 mm×15 mm (thickness) was prepared. The sample weight was measured by an electronic force balance and the dimensions thereof were measured by a micrometer. The bulk density W2 was calculated from the weight and dimensions. True density W1 of the abrasive molding was determined according to JIS-R-2205 by pulverizing a part of the sample to determine the true density W1, and the relative density was calculated from the following formula.

$$\text{Relative density}(\%)=(W2/W1)\times 100$$

(4) Average Particle Diameter of Abrasive Molding (μm)

A part of a sample abrasive molding was observed by a scanning electron microscope "ISI DS-130" available from Akashi Seisakusho K. K., Japan). The average particle diameter was determined on observed particles by an interseptive method.

(5) Pore Size Distribution

Porosity of an abrasive molding was measured by a mercury porosimeter ("Poresizer 9320" available from Shimadzu Corp., Japan) while mercury was penetrated therein at a pressure varying from 0 MPa to 270 MPa. The porosity was determined by calculating the minimum pore diameter, into which mercury was penetrated, and the total volume of pores with a diameter of at least equal to the minimum pore diameter, from the volume of penetrated mercury and the applied pressure.

(6) Compressive Strength of Abrasive Molding (kg/cm$^2$)

A ample abrasive molding having a size of 10 mm×10 mm×7 mm (thickness) was prepared. The compressive strength was measured according to JIS-R-1608 by using SHIMADZU Autograph IS-10T available from Shimadzu Corp., Japan, while a load was applied at a cross head speed of 0.5 mm/min.

(7) Surface State of Polished Material

The surface of polished material was observed by an optical microscope "BH-2" available from Olympus Optical Co., Japan. The evaluation results were expressed by the following two ratings.

Rating A: the surface was very smooth and there is no scratch.

Rating B: the surface was not smooth and could not be uniformly abraded.

(8) Rate of Abrasion (μm/min)

The rate of abrasion of a material to be polished was expressed by the reduction of thickness of the polished material per unit time, which was calculated from the thickness as measured by a dial gauge before and after polishing. The thickness was measured at voluntarily chosen ten points on the material surface to be polished, and an average value was calculated.

(9) Light Transmission of Waste Polishing Liquid (%)

Turbidity of a waste polishing liquid was measured by a spectrophotometer "Ubest-55" available from Nihon Bunko K. K., Japan. The light transmission was expressed by a relative value of the light transmission of the waste polishing liquid to that as measured on purified water at a wavelength of 600 nm. The larger the light transmission, the lower the content of loose abrasive grains in the waste polishing liquid. The smaller the light transmission, the higher the content of loose abrasive grains in the waste polishing liquid.

Preparation of Abrasive Moldings

Using powdery raw materials of titanium oxide, aluminum oxide or cerium oxide, having the compositions shown in Table 1, eight kinds of abrasive moldings (1) through (8) were prepared as follows. Each powdery raw material was incorporated with a poly(vinyl alcohol) powder, a poly(butyl methacrylate) powder or potato starch as a binder; the thus-mixed powder was press-molded under a pressure of 50 to 3,000 kg/cm$^2$ to form a molding; and the as-made molding was sintered at a temperature of 700 to 1,500° C. In the preparation of abrasive molding (1), any of the above-recited binders was not used.

The relative density (%), average particle diameter (μm), integrated pore volume (%) of pores with a diameter of 0.01–1 μm and integrated pore volume (%) of pores with a diameter of 1–360 μm, based on the integrated total pore volume of the entire pores, and compressive strength (kg/cm$^2$) of the abrasive moldings were evaluated. The results are shown in Table 1.

TABLE 1

| Abrasive moldings | 1 | 2 | 3 | 4 | 5 | 6 | 7 | 8 |
|---|---|---|---|---|---|---|---|---|
| Characteristics of raw material powder | | | | | | | | |
| Purity of titanium oxide powder (wt. %) | 99.9 | 99.9 | 99.9 | 99.9 | 99.9 | 99.9 | — | — |
| Purity of aluminum oxide powder (wt. %) | — | — | — | — | — | — | 99.9 | — |
| Purity of cerium oxide powder (wt. %) | — | — | — | — | — | — | — | 99.9 |
| Moisture content (wt. %) | 0.2 | 0.2 | 0.2 | 0.2 | 0.2 | 0.2 | 0.2 | 0.2 |
| Loss on ignition (wt. %) | 0.1 | 0.2 | 0.1 | 0.1 | 0.1 | 0.1 | 0.1 | 0.1 |
| Stock hardness | 320 | 320 | 320 | 320 | 320 | 320 | 1700 | 620 |
| Properties of abrasive moldings | | | | | | | | |
| Relative density (%) | 66 | 57 | 46 | 35 | 6 | 94 | 42 | 45 |
| Average particle | 0.84 | 0.06 | 0.73 | 0.03 | 0.61 | 1.41 | 0.32 | 0.12 |

TABLE 1-continued

| Abrasive moldings | 1 | 2 | 3 | 4 | 5 | 6 | 7 | 8 |
|---|---|---|---|---|---|---|---|---|
| diameter (μm) | | | | | | | | |
| Integrated pore volume 0.01–1 μm | 92 | 74 | 70 | 68 | 72 | 7 | 66 | 64 |
| Integrated pore volume 1–360 μm | 6 | 24 | 28 | 29 | 26 | 91 | 32 | 34 |
| Compressive strength ($kg/cm^2$) | ≧500 | ≧500 | ≧500 | 360 | ≦0.5 | ≧500 | 460 | 480 |

Polishing by Abrasive Moldings

EXAMPLES 1

COMPARATIVE EXAMPLES 1 to 4

Using materials to be polished (square plate having a size of 45 mm×45 mm, and a hardness shown in Table 1), and abrasive moldings, shown in Table 1, a polishing test was conducted as follows.

Abrasive moldings each having characteristics shown in Table 1 and a columnar shape having a diameter of 25 mm and a thickness of 5 mm was prepared. 100 abrasive moldings were fitted to a lower disc (diameter 300 mm) of a polishing apparatus "PLANOPOL/PEDEMAX 2" available from Struers Co. in a manner such that the polishing surfaces of the 100 abrasive moldings form a flat polishing surface. Each material to be finished having a square form with a size of 45 mm×45 mm was polished by the abrasive moldings-fitted disc at a lower disc revolution of 300 rpm and a working pressure of 80 $g/cm^2$, while a polishing liquid (an aqueous solution having a pH value of 4.5 adjusted with hydrogen peroxide) was dropped at a rate of 200 ml/min.

The surface state (surface smoothness) of the polished surface, the rate of abrasion, and light transmission of waste polishing liquid were evaluated. The results are shown in Table 2-1 and Table 2-2.

TABLE 2-1

| Examples | 1 | 2 | 3 | 4 | Ref. Ex. 1 |
|---|---|---|---|---|---|
| Abrasive moldings | 1 | 2 | 3 | 4 | 3 |
| Material to be polished | Al | Al | Al | Al | Quartz |
| Vickers hardness | 130 | 130 | 130 | 130 | 680 |
| Polished results | | | | | |
| Surface smoothness | A | A | A | A | A |
| Abrasion rate (μm/min) | 0.092 | 0.125 | 0.214 | 0.286 | 0.03 |
| Light transmission of waste polishing liquid (%) | 88 | 84 | 84 | 86 | 84 |

TABLE 2-2

| Comparative Example No. | 1 | 2 | 3 | 4 | 5 | 6 |
|---|---|---|---|---|---|---|
| Abrasive moldings | 5 | 6 | 7 | 8 | — | — |
| Material to be polished | Al | Al | Al | Al | Al | Al |
| Vickers hardness | 130 | 130 | 130 | 130 | 130 | 130 |
| Polished results | | | | | | |
| Surface smoothness | — | B | B | B | — | A |

TABLE 2-2-continued

| Comparative Example No. | 1 | 2 | 3 | 4 | 5 | 6 |
|---|---|---|---|---|---|---|
| Abrasion rate (μm/min) | — | — | — | — | ≦0.01 | 0.068 |
| Light transmission of waste polishing liquid (%) | — | — | — | — | — | 1 |

Reference Example 1

Using a quartz material (square plate having a size of 45 mm×45 mm) having a Vickers hardness shown in Table 2-1, and abrasive molding 3, a polishing test was conducted under the same conditions as those in Examples 1 to 5. The surface state (surface smoothness) of the polished surface, the rate of abrasion, and light transmission of waste polishing liquid were evaluated. The results are shown in Table 2-1.

As seen from Table 2-1 and Table 2-2, in Examples 1 to 4, materials to be polished having a Vickers hardness not larger than 300 $kg/mm^2$ could be polished at a high rate of abrasion to give a smooth surface. In contrast, in Comparative Example 1 using an abrasive molding having a too low relative density, the abrasive molding was damaged and polishing could not be effected, In Comparative Example 2 using an abrasive molding having a too high relative density, the polished surface had poor smoothness.

In Comparative Example 3 using an abrasive molding composed of aluminum oxide having a stock hardness of 1,700 $kg/mm^2$ and in Comparative Example 4 using an abrasive molding composed of cerium oxide having a stock hardness of 680 $kg/mm^2$, the polished surfaces were poor in smoothness. In reference Example 1 using an abrasive molding composed of quartz having a stock hardness of 680 $kg/mm^2$, a good polished surface could be obtained, but the rate of abrasion was very low.

COMPARATIVE EXAMPLE 5

A polishing pad made of commercially available polyurethane foam was attached to a lower disc (diameter 300 mm) of a polishing apparatus "PLANOPOL/PEDEMAX 2" available from Struers Co. An aluminum substrate having a size of 45 mm×45 mm was polished by the polishing pad-fitted disc at a lower disc revolution of 300 rpm and a working pressure of 80 $g/cm^2$, while a polishing liquid (an aqueous solution having a pH value of 4.5 adjusted with hydrogen peroxide) was dropped at a rate of 200 ml/min. The rate of abrasion was too low to determine.

COMPARATIVE EXAMPLE 6

A polishing pad made of commercially available polyurethane foam was attached to a lower disc (diameter 300 mm) of a polishing apparatus "PLANOPOL/PEDEMAX 2" available from Struers Co. A glass sheet having a size of 45 mm×45 mm was polished by the polishing pad-fitted disc at a lower disc revolution of 300 rpm and a working pressure of 80 $g/cm^2$, while a polishing liquid (an aqueous solution containing titanium oxide abrasive grains having an average particle diameter of 0.6 μm at a concentration of 20% by weight, which had been prepared by diluting with an aqueous solution having a pH value of 4.5 adjusted with hydrogen peroxide) was dropped at a rate of 200 ml/min.

The surface state of the polished surface, the rate of abrasion, and light transmission of waste polishing liquid were evaluated. The results are shown in Table 2-1 and Table 2-2.

As seen from comparison of Comparative Examples 5 and 6 with Examples 1 to 4, when a polishing pad and a polishing liquid containing no loose abrasive grains were used (Comparative Example 5), the rate of abrasion was very low. When a polishing pad and a polishing liquid containing loose abrasive grains were used (Comparative Example 6), the polishing could be conducted, but the polishing efficiency was low and the waste polishing liquid exhibited extremely low light transmission, namely, it contained a salient amount of loose abrasive grains When a material having a Vickers hardness not larger than 300 kg/mm$^2$ is polished with the abrasive molding of the present invention by using a polishing liquid containing no loose abrasive grains or containing a minor amount of loose abrasive grains, a smooth polished surface of the same level as or higher level than those of the conventional polishing processes using a polishing pad can be obtained at a high polishing efficiency. The polished surface does not have worn marks, and the problem of waste polishing liquid containing salient amount of loose abrasive grains is mitigated or avoided. The abrasive molding exhibits enhanced durability in the polishing process.

What is claimed is:

1. An abrasive molding comprising at least 90% by weight, based on the weight of the abrasive molding, of an inorganic material having a stock hardness of 50 kg/mm$^2$ to 400 kg/mm$^2$, wherein said abrasive molding is a sintered body made by sintering a molding of a powder of the inorganic material at a temperature of 700 to 1,500° C., has a relative density of 20% to 70% and is composed of particles of the inorganic material, said particles having an average particle diameter of 0.001 $\mu$m to 50 $\mu$m.

2. The abrasive molding according to claim 1, which has pores having a pore size distribution such that the integrated pore volume of pores having a diameter in the range of 0.01 $\mu$m to 1 $\mu$m is at least 20% of the integrated total pore volume of the entire pores within the abrasive molding.

3. The abrasive molding according to claim 2, wherein the pores have a pore size distribution such that the integrated pore volume of pores having a diameter in the range of 1 $\mu$m to 360 $\mu$m is in the range of 10% to 70% of the integrated total pore volume of the entire pores within the abrasive molding.

4. The abrasive molding according to claim 1, which is used for polishing a material having a Vickers hardness not larger than 300 kg/mm$^2$.

5. The abrasive molding according to claim 1, wherein the inorganic material is titanium oxide.

6. An abrasive molding comprising at least 90% by weight, based on the weight of the abrasive molding, of titanium oxide, and said abrasive molding having a relative density of 20% to 70% and an average particle diameter of 0.001 $\mu$m to 10 $\mu$m, and having pores with a pore size distribution such that the integrated pore volume of pores having a diameter in the range of 0.01 $\mu$m to 1 $\mu$m is at least 20% of the integrated total pore volume of the entire pores within the abrasive molding, and the integrated pore volume of pores having a diameter in the range of 1 $\mu$m to 360 $\mu$m is in the range of 10% to 70% of the integrated total pore volume of the entire pores within the abrasive molding.

7. An abrasive disc comprising at least one abrasive molding fixed to a supporting auxiliary, said abrasive molding comprising at least 90% by weight, based on the weight of the abrasive molding, of an inorganic material having a stock hardness of 50 kg/mm$^2$ to 400 kg/mm$^2$, wherein said abrasive molding is a sintered body made by sintering a molding of a powder of the inorganic material at a temperature of 700 to 1,500° C., has a relative density of 20% to 70% and is composed of particles of the inorganic material, said particles having an average particle diameter of 0.001 $\mu$m to 50 $\mu$m.

8. The abrasive disc according to claim 7, wherein said abrasive molding has pores having a pore size distribution such that the integrated pore volume of pores having a diameter in the range of 0.01 $\mu$m to 1 $\mu$m is at least 20% of the integrated total pore volume of the entire pores within the abrasive molding.

9. The abrasive disc according to claim 8, wherein the pores have a pore size distribution such that the integrated pore volume of pores having a diameter in the range of 1 $\mu$m to 360 $\mu$m is in the range of 10% to 70% of the integrated total pore volume of the entire pores within the abrasive molding.

10. The abrasive disc according to claim 7, wherein the inorganic material is titanium oxide.

11. An abrasive disc comprising at least one abrasive molding fixed to a supporting auxiliary; said abrasive molding comprising at least 90% by weight, based on the weight of the abrasive molding, of titanium oxide, and said abrasive molding having a relative density of 20% to 70% and an average particle diameter of 0.001 $\mu$m to 10 $\mu$m, and having pores with a pore size distribution such that the integrated pore volume of pores having a diameter in the range of 0.01 $\mu$m to 1 $\mu$m is at least 20% of the integrated total pore volume of the entire pores within the abrasive molding, and the integrated pore volume of pores having a diameter in the range of 1 $\mu$m to 360 $\mu$m is in the range of 10% to 70% of the integrated total pore volume of the entire pores within the abrasive molding.

* * * * *